US006641438B1

(12) United States Patent
Billman

(10) Patent No.: US 6,641,438 B1
(45) Date of Patent: Nov. 4, 2003

(54) HIGH SPEED, HIGH DENSITY BACKPLANE CONNECTOR

(75) Inventor: Timothy B. Billman, Dover, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/165,561

(22) Filed: Jun. 7, 2002

(51) Int. Cl.[7] ..... H01R 13/648
(52) U.S. Cl. ..... 439/608; 439/95; 439/607
(58) Field of Search ..... 439/608, 95, 607, 439/108, 101, 76.1, 701

(56) References Cited

U.S. PATENT DOCUMENTS 5,066,236 A * 11/1991 Broeksteeg ..... 439/79
5,104,341 A * 4/1992 Gilissen et al. ..... 439/608
5,433,617 A 7/1995 Morlion et al.
6,083,047 A * 7/2000 Paagman ..... 439/608
6,168,469 B1 * 1/2001 Lu ..... 439/608
6,171,115 B1 * 1/2001 Mickievicz et al. ..... 439/76.1
6,267,604 B1 * 7/2001 Mickievicz et al. ..... 439/79
6,299,484 B2 10/2001 Van Woensel
6,375,508 B1 * 4/2002 Pickles et al. ..... 439/608
6,390,857 B1 * 5/2002 Pickles et al. ..... 439/701

* cited by examiner

*Primary Examiner*—Gary Paumen
(74) *Attorney, Agent, or Firm*—Wei Te Chung

(57) ABSTRACT

A backplane connector (100) includes a connector housing (1) defining plural openings (14) therethrough, a number of signal terminals (11) arranged in the connector housing, a number of circuit boards (2) retained in respective openings, and a shield member (3). Each circuit board is provided with signal traces (20) and conductive layer (21) on opposite sides thereof. The shield member substantially encloses the connector housing and the circuit boards. The shield member has a number of inwardly projected, resilient tabs (301) stamped therefrom. The resilient tabs are arranged in two staggered rows and each extend between adjacent circuit boards for mechanically and electrically contacting with the conductive layer of a corresponding circuit board to thereby achieve a grounding purpose.

25 Claims, 10 Drawing Sheets

HIGH SPEED, HIGH DENSITY BACKPLANE CONNECTOR

CROSS-REFERENCE TO RELATED APPLICATIONS

This patent applicant is a Application of patent application Ser. No. 10/162,724 filed on Jun. 4, 2002, entitled "HIGH DENSITY ELECTRICAL CONNECTOR WITH LEAD-IN DEVICE" invented by Timothy Brain Billman and Iosif Korsunsky, and Ser. No. 10/154,318 filed May 22, 2002, entitled "HIGH DENSITY ELECTRICAL CONNECTOR", invented by Timothy Brain Billman, all assigned to the same assignee.

BACKGROUND OF THE INVENTION

1. Field of the Invention

The present invention relates to an electrical connector, and particularly to a high density, shielded backplane connector used to connect daughter boards with a mother board and transmit high speed signals therebetween.

2. Description of Prior Art

Many electronic systems employ electrical connectors to interconnect printed circuit boards used therewith. It is generally easier and more cost effective to manufacture a system on several printed circuit boards which are then joined together by electrical connectors. A traditional arrangement for joining several printed circuit boards is to have one printed circuit board serve as a backplane. Other printed circuit boards, called daughter boards, are connected to the backplane. Since electronic systems have gotten smaller and faster in handling much more data than ever, electrical connectors must carry more and faster data signals in a smaller space without degrading the signals. High density, high speed electrical connectors, just as their names imply, carrying more and faster data signals in a smaller space through signal contacts are coming into use. As the signal contacts are placed closer and the speed of the signals increases, electromagnetic interference and the cross-talk become an important issue.

U.S. Pat. Nos. 5,066,236 and 5,104,341, both issued to AMP Incorporated, disclose a backplane receptacle connector mountable to a printed circuit board having shield members. Cross-talk shield members are insertable into the rear of the connector housing to shield adjacent rows of terminals from cross-talk, while upper and lower shield members are insertable over the assembly to shield the assembly from EMI/RFI. However, it should be noted that a header for mating with the backplane receptacle connector is provided with grounding contacts to electrically connect with resilient fingers of the upper and lower shield members thereby establishing a grounding circuitry therebetween. The arrangement of positioning the grounding contacts between signal pins of the header reduces the effective signal density of the header. Significantly, the employment of the upper and lower shield members complexes the manufacture of the connector as well as the assembly thereof.

Similar shield member design is implemented in Molex Incorporated product, named MZP™ hard metric connector, which can be found in website of Molex, http://www.molex.com.

U.S. Pat. No. 5,433,617, issued to Framatome Connectors International, dated Jul. 18, 1995, discloses a backplane connector assembly. The backplane connector assembly is composed of a header connector and a receptacle connector, mounted on respective printed circuit boards, wherein the header connector provides first shielding plates therewith while the receptacle connector provides side-by-side positioned, ground contact plates and a second shielding plate therewith. Consequentially, electrical contacts and mechanical supports are established between corresponding parts of the first shielding plate, the second shielding plate and the ground contact plates. Specially, in the coupled position of the assembly, the first shielding plates of the header provides contact springs simultaneously engaging the edges of the ground contact plates and the second shielding plate of the receptacle. Further, the first shield plates and the ground contact plates have individual contact area or contact elements thereof contacting suitable conductor of the printed circuit boards on which the header and the receptacle are respectively mounted. Similarly, the second shielding plate of the receptacle provides contact parts inserted into openings of the corresponding printed circuit board and contacting a corresponding conductor of the printed circuit board. Thus, the ground route of the assembly is formed. Moreover, in an alternative embodiment of the patent, a third shield plate is even provided. Obviously, the connector assembly as described above, is unsuitable for mass-produce due to complicated manufacturing process and assembling process, both of which increase the cost.

In U.S. Pat. No. 6,299,484, which is another patent assigned to Framatome Connectors International, a backplane connector is introduced. The backplane connector comprises at least one shielding plate arranged between two adjacent rows of contact elements, and a shielding member mounted on the assembled connector housings. The shielding member includes a plurality of contact springs stamped therefrom and contacting edges of the shielding plates to achieve a shielding purpose. However, the shielding effectiveness of the patent is not totally satisfied for that the contact between the shielding member and the slender edges of the shielding plates is unreliable.

Hence, an improved backplane connector is desired to overcome the disadvantages of the prior arts.

BRIEF SUMMARY OF THE INVENTION

Accordingly, an object of the present invention is to provide a high speed, high density backplane connector having a shield member to achieve a better EMI protection.

In order to achieve the above-mentioned object, a backplane connector in accordance with the present invention includes a plurality of wafers defining therebetween receiving openings, circuit boards retained in the receiving openings of the wafers, and a shield member covering the wafers and the printed circuit boards. Each wafer includes a dielectric base, a plurality of signal terminals received in one side of the base, and a grounding bus attached on an opposite side of the dielectric base. Each circuit board is provided with signal traces and conductive layer coated thereon. The shield is stamped from a piece of metal sheet and has a horizontally extended intermediate portion and a downwardly extended rear portion. The intermediate portion substantially covers a top of the circuit boards, and the rear portion substantially covers a rear of the circuit boards. A number of resilient tabs are stamped from the intermediate portion and arranged in two staggered rows. Each of the resilient tabs protrudes inwardly and extends between adjacent two circuit boards. The resilient tabs separates adjacent circuit boards and electrically contact with the grounding layers of corresponding circuit boards thereby achieving grounding requirement.

Other objects, advantages and novel features of the invention will become more apparent from the following detailed description of the present embodiment when taken in conjunction with the accompanying drawings.

DETAILED DESCRIPTION OF THE INVENTION

Figure 1:
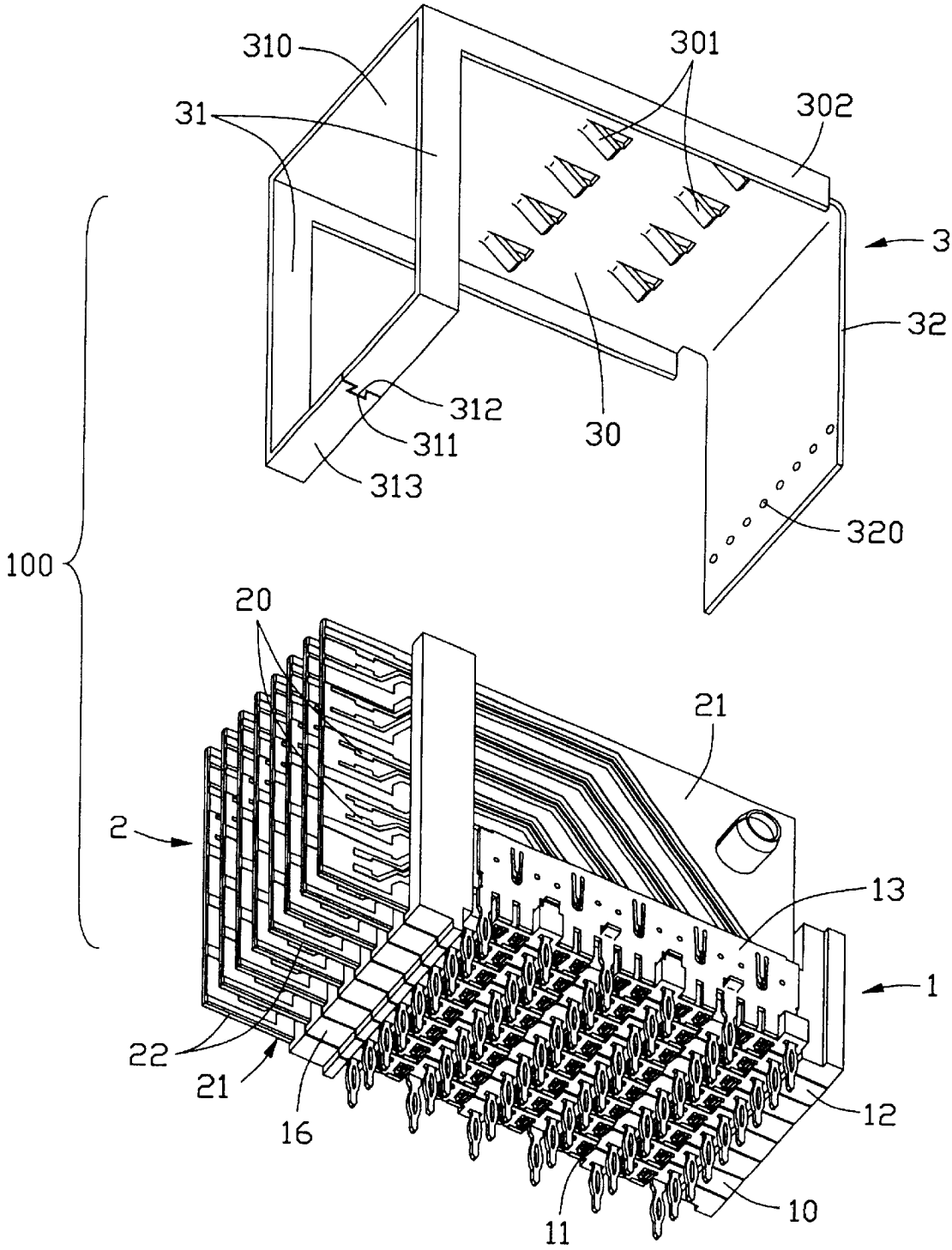
FIG. 1 is a partially exploded view of a backplane connector in accordance with a first embodiment of the present invention.
Figure 2:
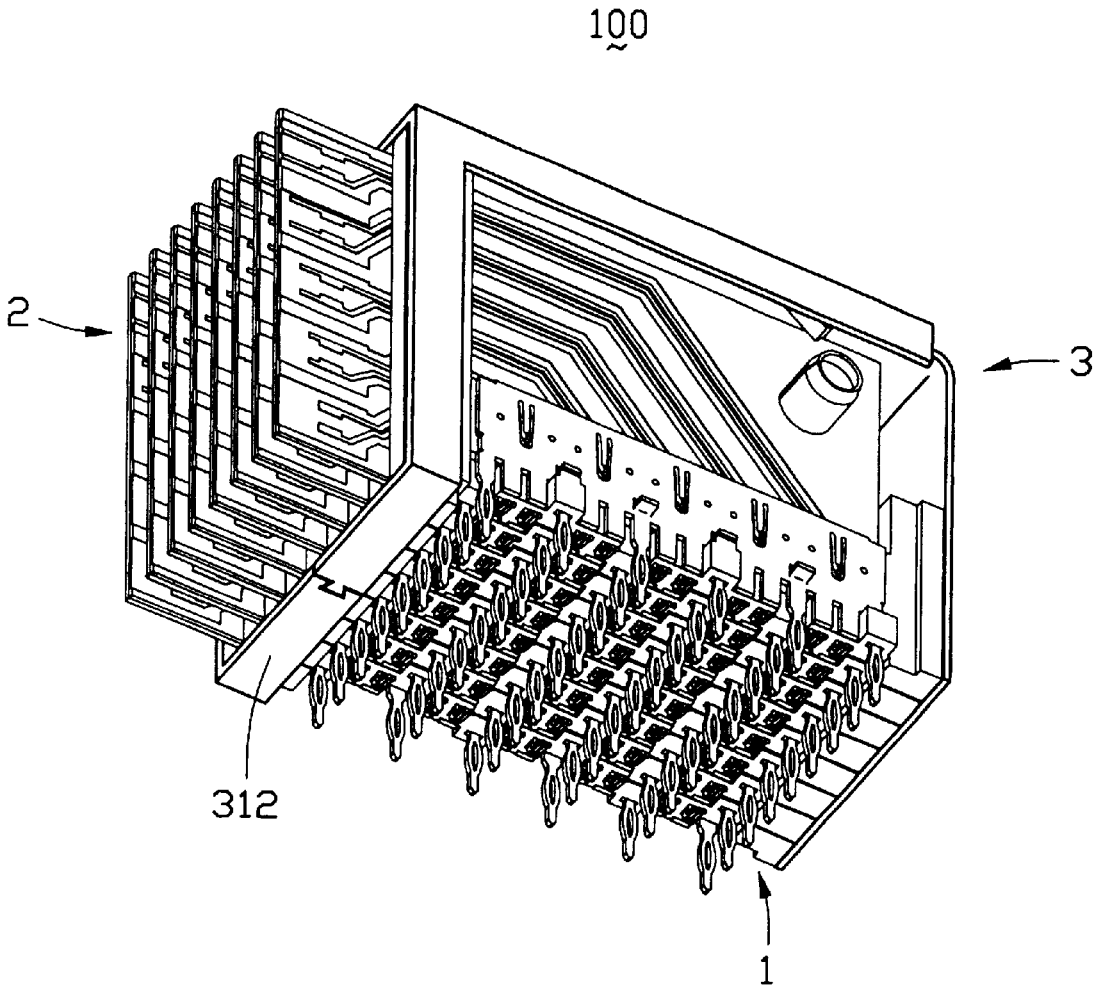
FIG. 2 is an assembled view of FIG. 1.
Figure 3:
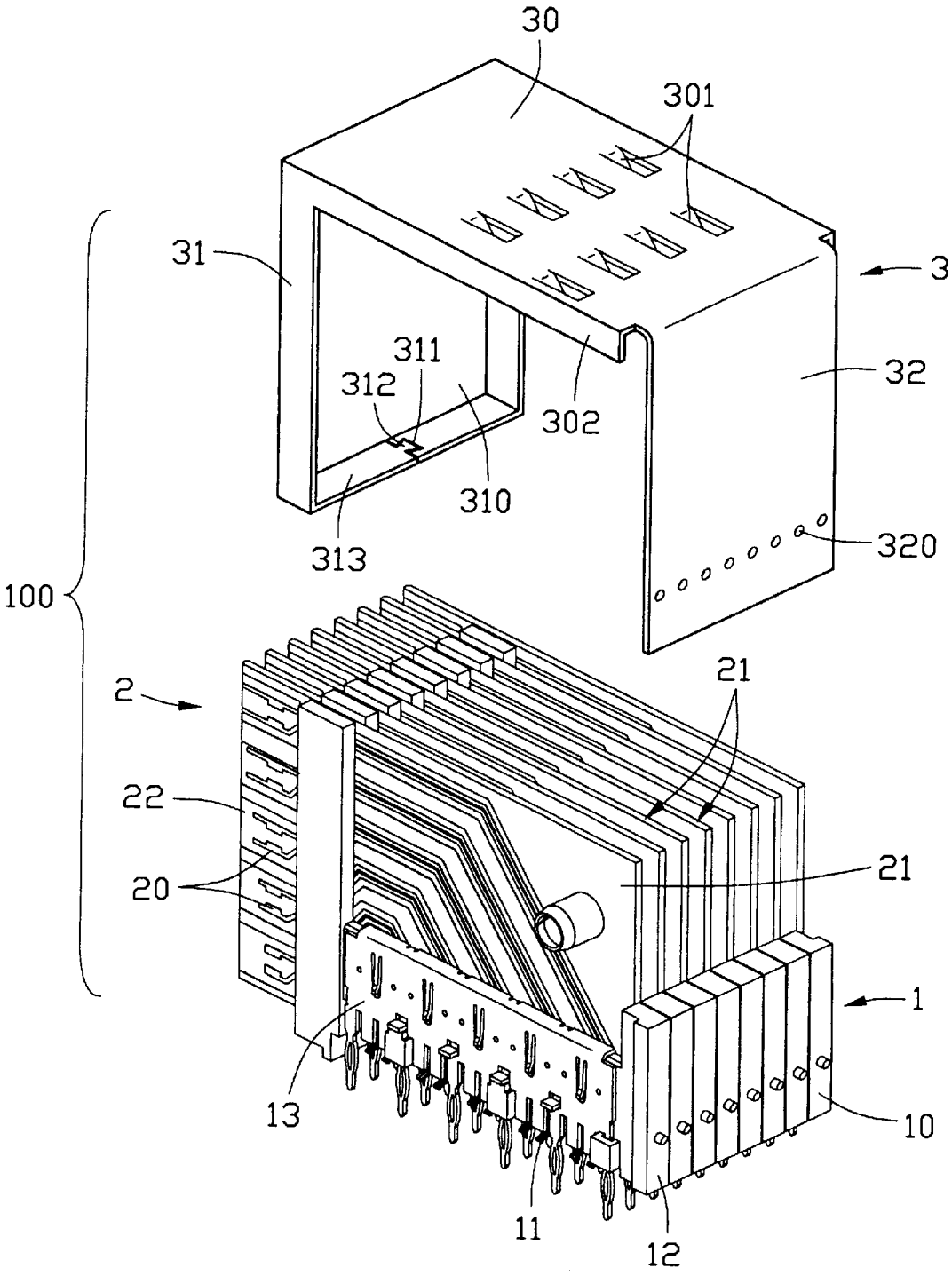
FIG. 3 is a view similar to FIG. 1 while taken from a different aspect.
Figure 4:
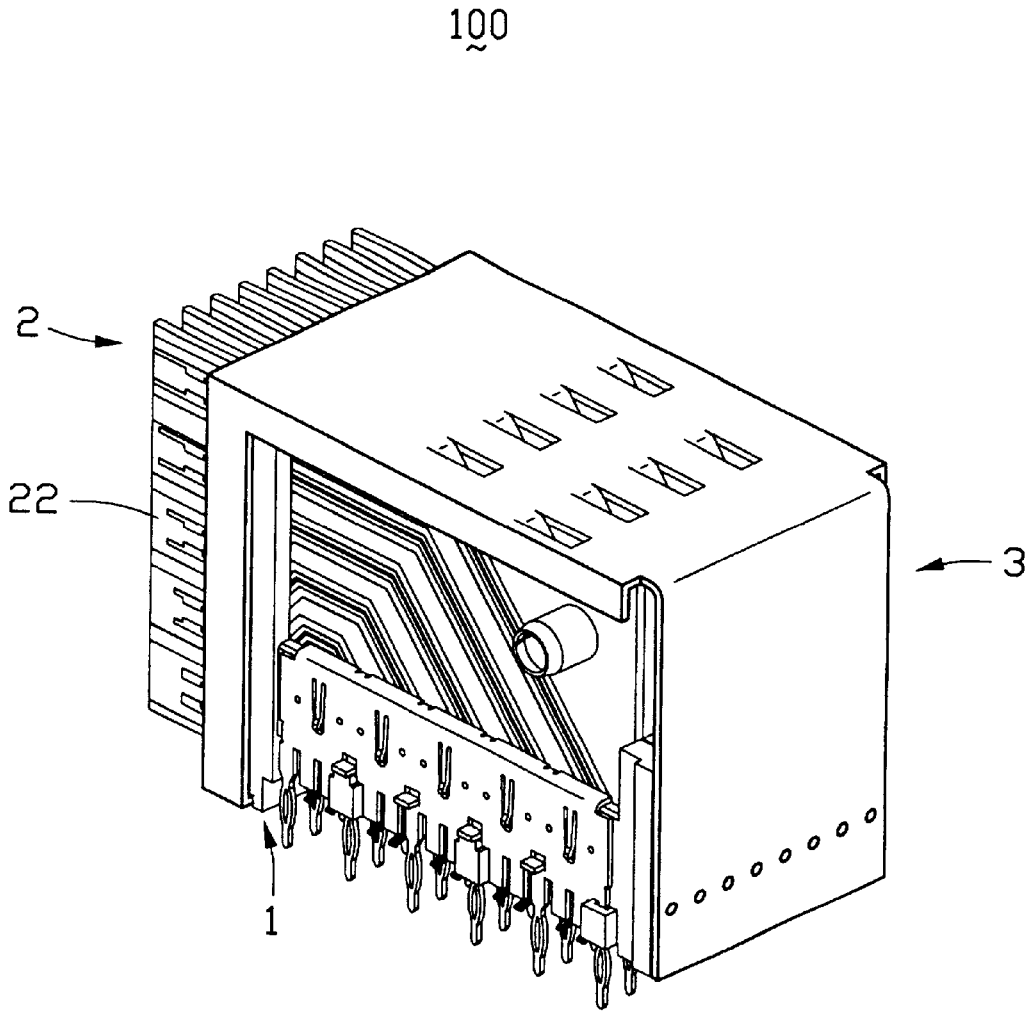
FIG. 4 is an assembled view of FIG. 3.
Figure 5:
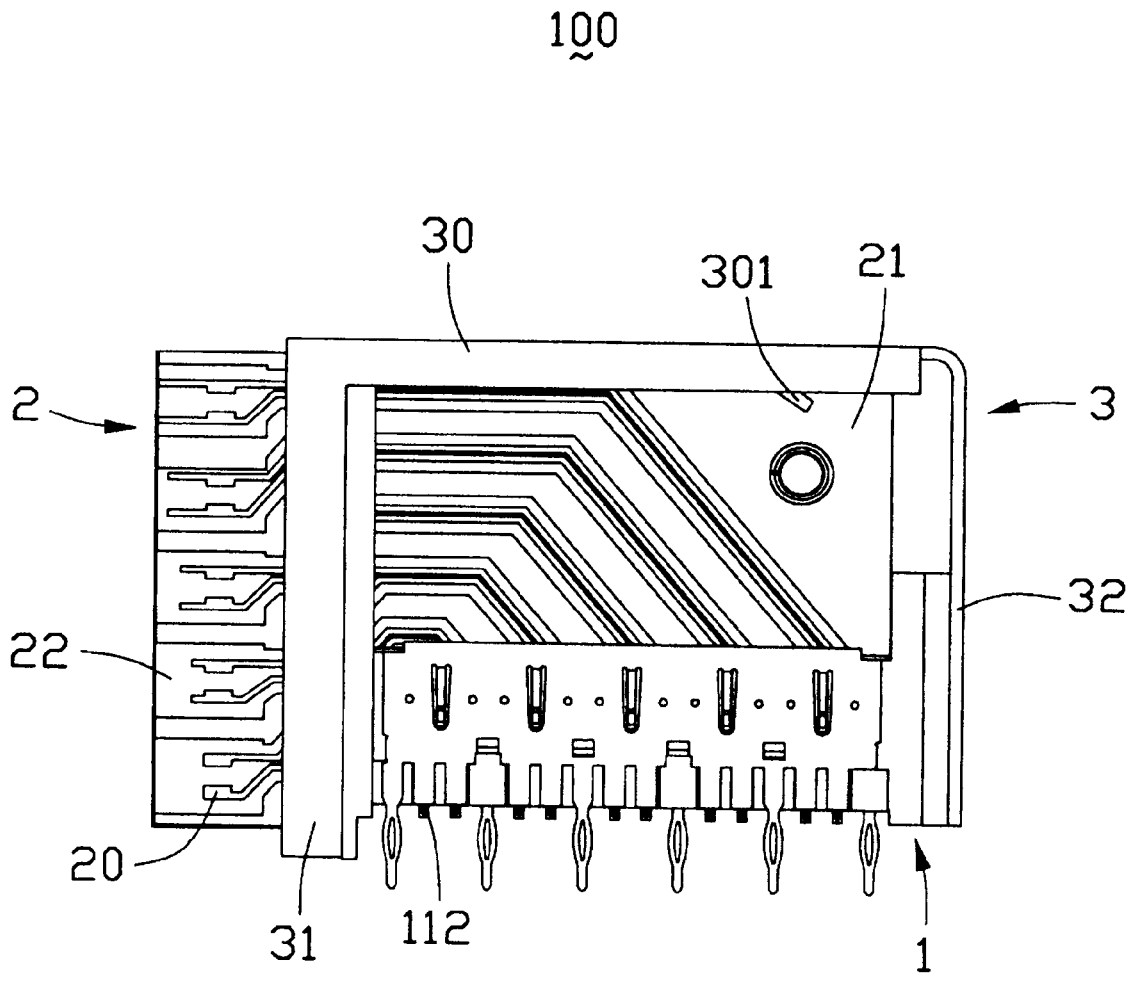
FIG. 5 is a side plan view of FIG. 4.
Figure 6:
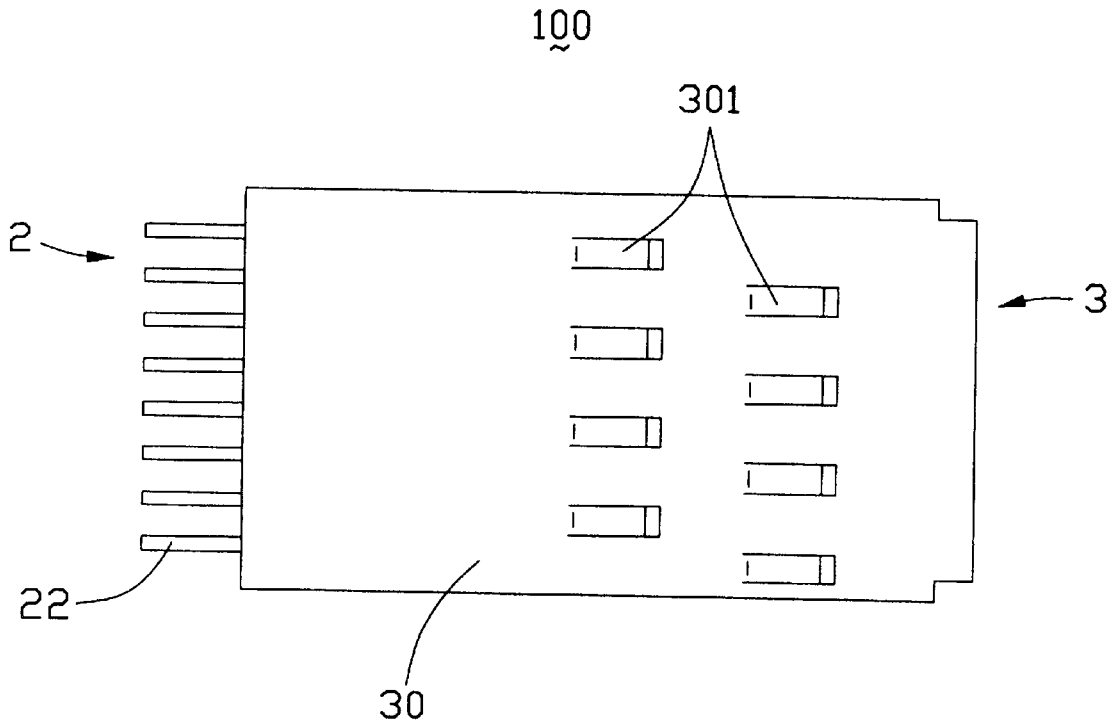
FIG. 6 is a top plan view of FIG. 4.

Reference will now be made to the drawing figures to describe the present invention in detail.

FIGS. 1 through 6 illustrate an exemplary backplane connector 100 constructed in accordance with the present invention, which is adopted for interconnecting a mother board and daughter boards (neither one is shown) via a backplane header (not shown). The backplane connector 100 comprises a connector housing part 1, a number of parallelly arranged circuit boards 2, and a metal shield member 3 covering the connector housing part 1.

Each circuit board 2 of the backplane connector 100 has one side face thereof provided with pairs of signal traces 20. An area of the one side face other than the signal traces 20 and an opposite side face are substantially coated with a conductive layer 21. The conductive layer 21 is used as grounding plane for the circuit board 2. The circuit boards 2 are positioned and organized within the connector housing part 1 for reliably mating with the backplane header to thereby steadily transmitting the massive data between the mother board and the daughter board at a relative high speed.

Figure 7:
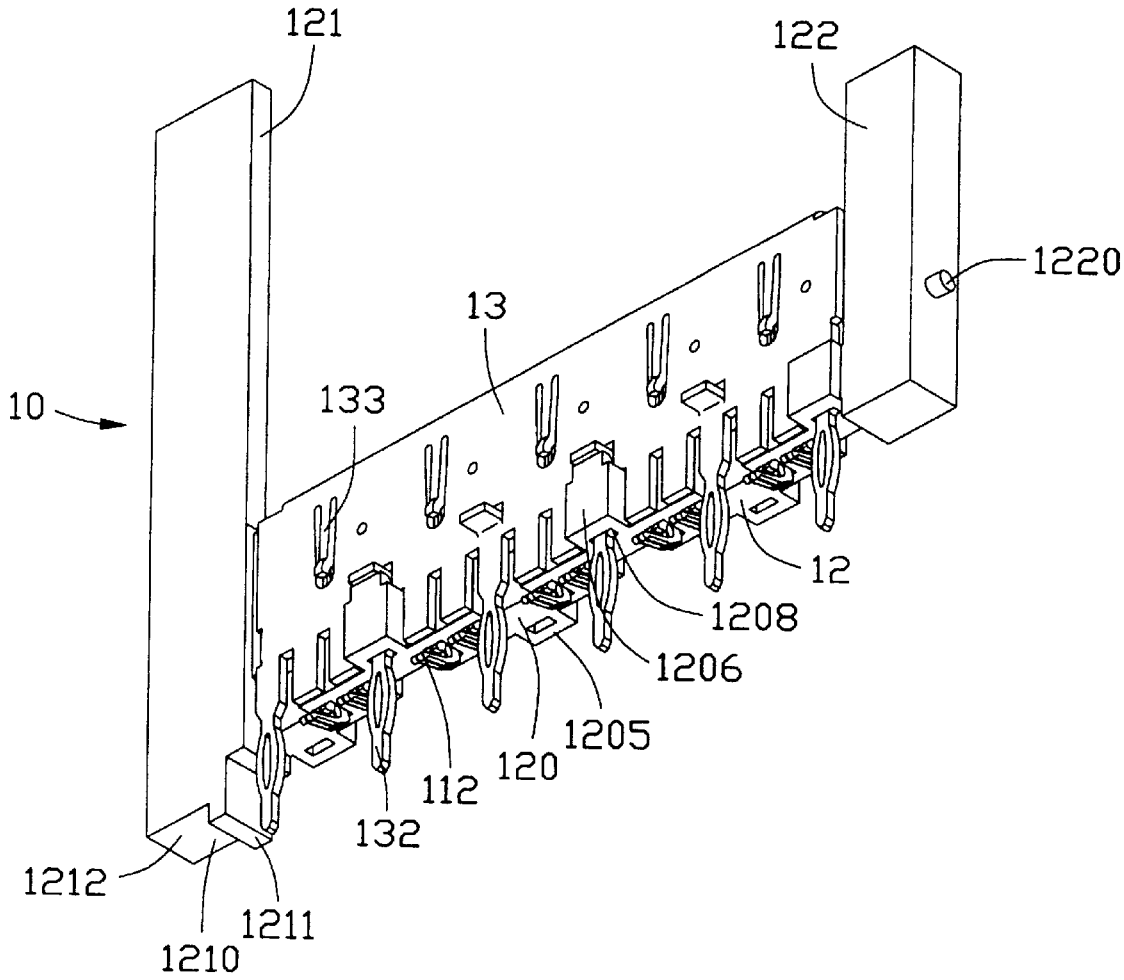
FIG. 7 is an enlarged, perspective view of a wafer of the backplane connector shown in FIG. 1.
Figure 8:
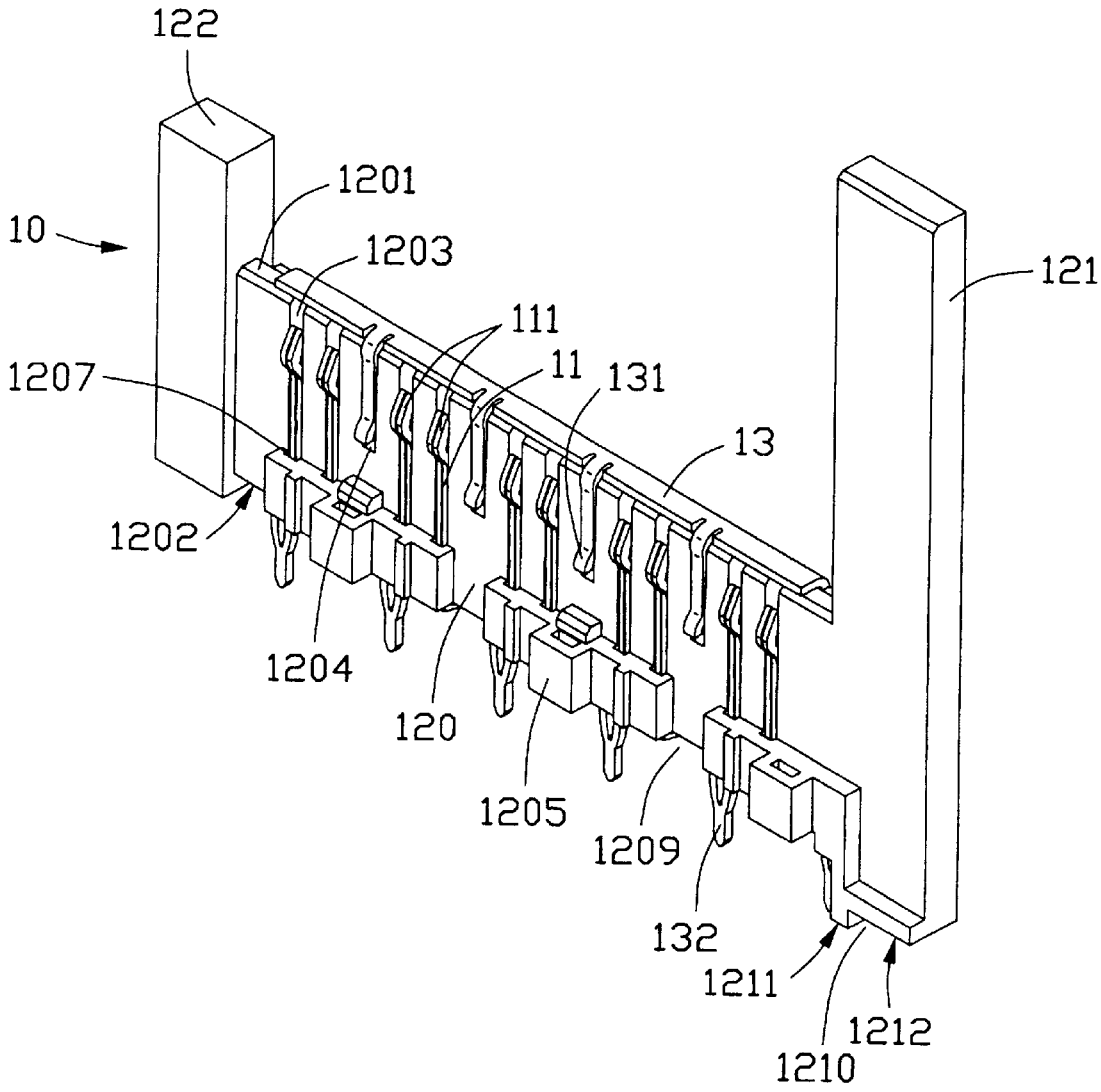
FIG. 8 is a similar view to FIG. 7 while taken from a different aspect.

In a first embodiment of the present invention, the connector housing part 1 is preferably composed of a multiplicity of identical wafers 10 stacked side by side. However, in an alternative embodiment, the connector housing part 1 may be manufactured integrally. As shown in FIGS. 7 and 8, each wafer 10 comprises a dielectric base 12, a row of signal terminals 11 and a grounding bus 13 respectively attached on opposite sides of the dielectric base 12.

Each signal terminal 11 comprises a mating portion 111 (FIG. 8) and a board mounting portion 112. The board mounting portions 112 are for electrically engaging with corresponding conductive pads on the mother board, on which the backplane connector 100 is mounted, while the mating portions 111 electrically engage with corresponding signal traces 20 on the circuit boards 2 for providing the backplane connector 100 with a signal path from the mother board to the backplane header.

The dielectric base 12 of each wafer 10 has a front pole 121 upstanding from a front end, a rear pole 122 upstanding from an opposite rear end, and a main body 120 extending longitudinally between the front and rear poles 121, 122. The front pole 121 of the dielectric base 12 defines a depression 1210 on a bottom face 1211 and forms a concave surface 1212 thereby. The rear pole 122 is provided with a column-shaped embossment 1220 on a rear side thereof.

The main body 120 of the dielectric base 12 generally has an upper face 1201 and an opposite lower face 1202, and defines a plurality of channels 1203 on one side thereof extending from the upper face 1201 to the lower face 1202 for receiving therein respective signal terminals 11. A number of grooves 1204 are equidistantly arranged between every two channels 1203 and opened to the upper face 1201 of the main body 120 for receiving corresponding parts of the individual grounding bus 13, which will be described in detail hereinafter. The main body 120 is provided with plural first and second blocks 1205, 1206 formed on opposite sides thereof, respectively. The first blocks 1205 of the main body 120 define therethrough a number of square first holes 1207 communicating with the channels 1203 for organizing and retaining the signal terminals 11. Similarly, the second blocks 1206 define therethrough square second holes 1208 for receiving corresponding parts of the grounding bus 13.

Still referring to FIGS. 7 and 8, the grounding bus 13 of the wafer 10 is formed by stamping a metal sheet. A plurality of ground fingers 131 extend downwardly from a longitudinal edge of the grounding bus 13 and are received in the corresponding grooves 1204, respectively. Opposite to the ground fingers 131 plural ground pins 132 extend downwardly from a bottom of the grounding bus 13 for press-fit in through-holes of the mother board to thus reach the requirement of grounding. Further, the grounding bus 13 is provided with spring tabs 133 stamped therefrom for electrically contacting with the conductive layer 21 of a corresponding circuit board 2 on the opposite side face of the wafer 10.

Figure 9:
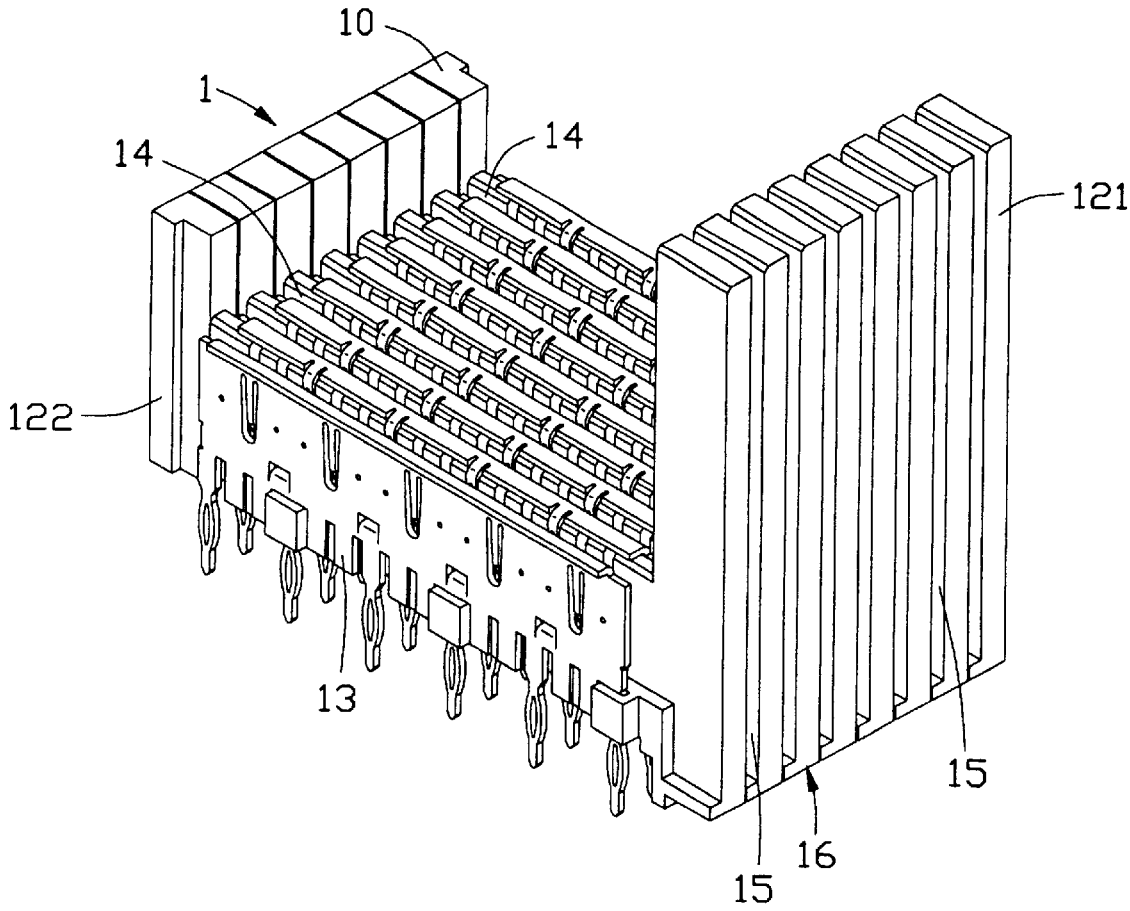
FIG. 9 is a perspective view showing a plurality of wafers of FIG. 7 assembled together.

Particularly referring to FIG. 9, a connector housing part 1 formed by assembling the plurality of wafers 10 is illustrated. It is readily to see that a circuit board receiving opening 14 is respectively defined between the main bodies 120 of adjacent wafers 10 for substantially receiving therein the corresponding circuit board 2. A deep slot 15 is defined between the front poles 121 of the adjacent wafers 10 and communicating with the circuit board receiving opening 14 for providing an entrance for the circuit board 2 to pass therethrough. The first blocks 1205 of a wafer 10 defines therebetween a recess 1209 for receiving a second block 1206 of an adjacent wafer 10 to thus assemble the wafers 10 side by side.

Turning back to FIGS. 1 and 3, the shield member 3 of the present invention is integrally stamped from a metal sheet. The shield member 3 comprises a horizontally extended, intermediate plane 30, a pair of front arms 31 formed in front of the intermediate plane 30, and a rear plane 32 extending downwardly from a rear edge of the intermediate plane 30.

The intermediate plane 30 of the shield member 3 has a plurality of resilient tabs 301 stamped therefrom and projecting downwardly. The resilient tabs 301 are staggered arranged in two rows. Each tab 201 is for extending between two adjacent circuit boards 2, and electrically contact the conductive layers 21 of the two circuit boards 2 to thus establish a grounding route between the shield member 3 and the two circuit boards 2. The pair of front arms 31 are bent and jointed together via a wedge-shape recess 311 and a wedge-shape protrusion 312 thereof to define a rectangular opening 310. The rectangular opening 310 is configured to receive the front poles 121 of the wafers 10. The rear plane 32 of the shield member 3 defines a number of apertures 320 for engaging with corresponding embossments 1220 on the rear poles 122 to thereby retaining the rear plane 32 on the connector housing part 1. The shield member 3 also has a pair of flanges 302 extending from opposite lateral edges of the intermediate plane 30.

In assembly, the circuit boards 2 are firstly received in corresponding openings 14 of the connector housing part 1 with mating portions 22 thereof being retained in respective deep slots 15 and extending forwardly beyond respective front poles 121 for engaging with the complementary backplane header. Each circuit board 2 is pressed from both sides by two corresponding adjacent wafers 10, whereby the grounding fingers 131 of one wafer 10 electrically contact to the conductive layer 21 on the one side of the circuit board 2 and the spring tabs 133 of the other wafer 10 electrically contact to the conductive layer 21 on the opposite side of the circuit board 2. The mating portions 111 of the signal terminals 11 contact with the signal traces 20 of the circuit board 2.

The concave surfaces 1212 of the front poles 121 are jointed to each other and together define a substantially planar, bottom concave face 16 thereby. The shield member 3 is then attached onto the circuit boards 2 and the connector housing part 1, with the bent portions 313 of the pair of front arms 31 abutting against the bottom concave face 16 and the apertures 320 of the rear plane 32 receiving the corresponding embossments 1220 of the rear poles 122, thereby embracing the plurality of circuit boards 2 and securing the shield member 3 on the connector housing part 1. The staggered, resilient tabs 301 of the shield member 3 each extend between two neighboring circuit boards 2 and contact with the conductive layers 21 of the two circuit boards 2 for grounding purpose. Further, it should be noted that the staggered, resilient tabs 301 of the shield member 3 facilitate the positioning stability of the circuit boards 2 in the connector housing part 1.

In brief, firstly, the individual wafers 10 are assembled to each other to thereby form the connector housing part 1. Then, the plurality of circuit boards 2 is inserted into and received in the connector housing part 1. Finally, the shield member 3 is attached onto and firmly binds up the connector housing part 1 and the circuit boards 2 together with the resilient tabs 301 of the shield member 3 respectively separating two adjacent circuit boards 2 and contacting with the conductive layers 21 thereof.

Figure 10:
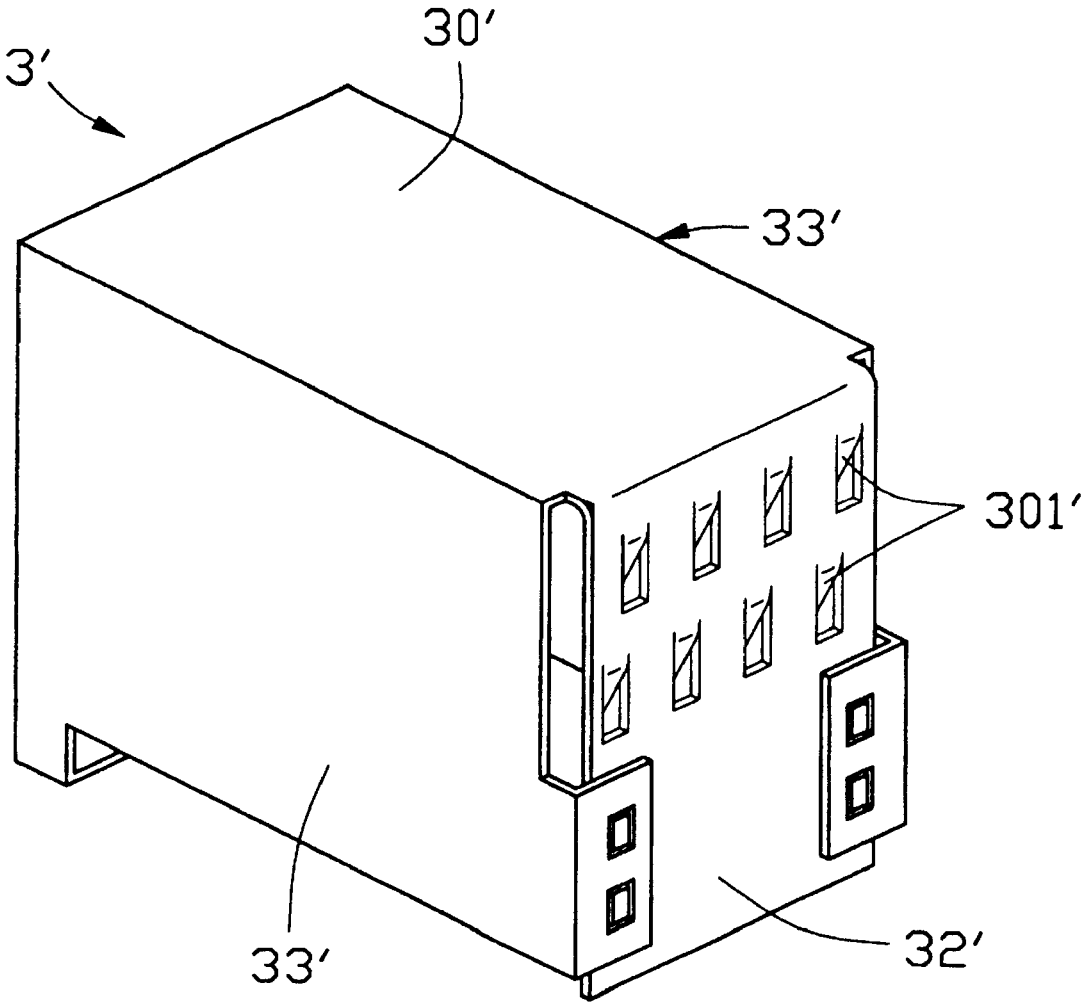
FIG. 10 is a perspective view of a shield member of a second embodiment of the present invention.

Particularly referring to FIG. 10, a shield member 3' in accordance with a second embodiment of the present invention is illustrated. The shield member 3' is configured as a rectangular box and is stamped from a metal sheet, which is similar to the shield member 3 of the first embodiment. Compared with the shield member 3 of the first embodiment of the present invention, the shield member 3' of the second embodiment further has a pair of side plates 33' extending downwardly from opposite side edges of a top plate 30' thus to substantially cover opposite outermost wafers 10 and corresponding circuit boards 2 so that a better EMI protection can be achieved. Furthermore, a number of resilient tabs 301' are stamped from and arranged in a rear plate 32' of the shield member 3'. The rear plate 32' projects from a rear edge of the top plate 30' and extends towards the mother board on which the backplane connector 100 is mounted. The resilient tabs 301' function similar to the resilient tabs 301.

It can be readily seen from the above description, the application of the shield member 3, 3' provides the backplane connector 100 with a substantial EMI protection. Therefore, the massive data signals carried in the backplane connector 100 can be transmitted at a considerably high speed without distortion.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting to a printed circuit board comprising:

a connector housing, said connector housing having plural signal terminals arranged in rows and defining plural parallel openings between adjacent rows of signal terminals;

a number of parallel arranged circuit boards retained in respective openings of said connector housing, each of said circuit boards having signal traces provided on one side thereof and having a conductive layer coated beside said signal traces and simultaneously coated on the other side of said each of the circuit boards, said signal terminals of said connector housing electrically connecting with said signal traces; and a metal shield member substantially enclosing said connector housing and said circuit boards, said shield member having a number of resilient tabs, said resilient tabs extending between adjacent circuit boards and electrically contacting with said conductive layer of said circuit boards to thereby achieve a grounding purpose.

2. The electrical connector as described in claim 1, wherein said shield member defines a plurality of apertures thereon and said connector housing correspondingly forms a plurality of column-shaped embossments received in said apertures for facilitating securing said shield member on said connector housing.

3. The electrical connector as described in claim 1, wherein said connector housing forms a concave face thereon and said shield member has a pair of arms connected to each other and abutting against said concave face of said connector housing.

4. The electrical connector as described in claim 1, wherein said shield member is configured as a rectangular box and stamped from a piece of metal sheet, said shield member substantially enclosing said connector housing and said circuit boards for EMI protection.

5. The electrical connector as described in claim 4, wherein said shield member has an intermediate plate with said resilient tabs being stamped therefrom and a pair of side plates extending from opposite lateral edges of the intermediate plate.

6. The electrical connector as described in claim 1, wherein said shield member comprises an intermediate portion covering a top of said parallel arranged circuit boards and a downwardly extended, rear portion connecting with said intermediate portion.

7. The electrical connector as described in claim 6, wherein said resilient tabs of said shield member are arranged in two rows and staggered with each other for separating adjacent circuit boards.

8. The electrical connector as described in claim 7, wherein said shield member further has a pair of arms extending downwardly from opposite forward lateral edges of said intermediate portion, said pair of arms partially embracing said parallel arranged circuit boards.

9. The electrical connector as described in claim 8, wherein said connector housing comprises plural wafers assembled side by side, each wafer including a dielectric base receiving a row of said signal terminals in one side thereof and a grounding bus attached on the other side of said dielectric base.

10. The electrical connector as described in claim 9, wherein said dielectric base has a front portion extending upwards from an end thereof, adjacent two of said front portions defining therebetween a slot communicating with a corresponding opening of said connector housing for extension and retention of a corresponding circuit board.

11. The electrical connector as described in claim 10, wherein said dielectric base of said wafer has a top surface and an opposite bottom surface, and said dielectric base defines a plurality of channels extending along a side thereof from said top surface to said opposite bottom surface and a plurality of grooves recessed between every two channels.

12. The electrical connector as described in claim 11, wherein said grounding bus comprises ground pins for fitting to said printed circuit board, ground fingers received in corresponding grooves of said dielectric base electrically engaging one of two neighboring circuit boards, and spring tabs contacting the conductive layer of the other one of the two neighboring circuit boards.

13. The electrical connector as described in claim 12, wherein each of said signal terminals comprises a mating portion for conductively contacting to said signal traces on said circuit board and a mounting portion for electrically contacting to the printed circuit board, said mating portion being disposed in a corresponding channel and said mounting portion extending beyond said bottom surface of said dielectric base.

14. The electrical connector as described in claim 13, wherein said dielectric base of said wafer arranges first and second blocks on opposite sides thereof in a staggered manner, adjacent first blocks defining a recess therebetween for receiving a corresponding second block of an adjacent wafer to thereby assembling said plural wafers together to form said connector housing.

15. An electrical connector adapted for mating with a complementary connector to thereby interconnect a mother board with a daughter board and transmitting massive, high speed data signals therebetween, comprising:

a number of individual wafers being assembled to each other and defining therebetween a number of receiving openings, each of said wafers comprising a dielectric base, a grounding member and a plurality of terminals arranged in said dielectric base;

a number of circuit boards respectively received in said receiving openings of said wafers, each of said circuit boards provided with signal traces and grounding traces thereon; and a metal shield member substantially enclosing said wafers and said circuit boards, said shield member stamping therefrom resilient tabs, each of said resilient tabs electrically connecting to said grounding trace of a corresponding circuit board;

wherein each grounding member has grounding fingers electrically connecting to said grounding traces of a corresponding circuit board and each of said terminals has a contacting end electrically connecting to said signal traces of said corresponding circuit board, each of said grounding members has grounding pins for electrically engaging with the mother board thus to substantially ground said shield member.

16. The electrical connector as described in claim 15, wherein said shield member is configured in a box shape and is stamped from a metal sheet.

17. The electrical connector as described in claim 16, wherein said shield member comprises a top plate covering said wafers and said circuit boards, and a rear plate extending from a rear edge of said top plate, said resilient tabs being stamped from said rear plate and extending inwardly between two adjacent arranged circuit boards and electrically connecting thereto.

18. The electrical connector as described in claim 16, wherein said shield member comprises a top plate covering said wafers and said circuit boards, said resilient tabs being stamped from said top plate and extending inwardly between two adjacent arranged circuit boards and electrically connecting thereto.

19. The electrical connector as described in claim 18, wherein said dielectric base of said wafer has a front portion extending upwards from an end thereof, adjacent two of said front portions defining therebetween a slot communicating with a corresponding receiving opening for retaining and passing thereby a corresponding circuit board.

20. The electrical connector as described in claim 19, wherein said dielectric base has a top surface and an opposite bottom surface, and said dielectric base defines a plurality of channels on one side thereof extending from said top surface to said opposite bottom surface for receiving said contacting ends of corresponding terminals, and a plurality of grooves recessed between every two channels for receiving corresponding grounding fingers of said grounding member.

21. The electrical connector as described in claim 20, wherein each of said grounding members further comprises spring tabs stamped thereon for electrically contacting to said grounding traces of a corresponding circuit board.

22. The electrical connector as described in claim 21, wherein each of said terminals further comprises a mounting end for electrically contacting to said mother board, said mounting ends extending downwards beyond said bottom surface of said dielectric base.

23. The electrical connector as described in claim 22, wherein said dielectric base arranges first and second blocks on opposite sides thereof in a staggered manner, adjacent two of the first blocks defining a recess therebetween for receiving a corresponding second block of an adjacent wafer to thereby assembly said plural wafers together.

24. An electrical connector comprising:

an insulative housing having a plurality of signal terminals arranged in rows;

plural rows of openings formed between adjacent two rows of signal terminals;

a plurality of parallel arranged printed circuit boards received in the corresponding openings, respectively;

a plurality of grounding traces formed on edge portions of the printed circuit boards, respectively; and a metallic shield enclosing the housing and the printed circuit boards therein; wherein said shield, includes a plurality of inwardly extending tabs not only dividing the corresponding two adjacent printed circuit boards for mechanical consideration, but also contacting the grounding traces on at least one of said two adjacent printed circuit boards for electrical consideration.

25. The connector as described in claim 24, further including plural rows of grounding buses alternately arranged with said plural rows of signal contacts in the housing and electrically connected to the grounding traces of the corresponding printed circuit board located aside.

* * * * *